US006016913A

United States Patent [19]

Tilton

[11] Patent Number: 6,016,913

[45] **Date of Patent: *Jan. 25, 2000**

[54] COMBINED PLASTIC FLEXIBLE FILM AND PAPERBOARD PRODUCT-RETENTION PACKAGES

[75] Inventor: Christopher R. Tilton, Conyers, Ga.

[73] Assignee: Walco Packaging Company, Inc., Conyers, Ga.

[ * ] Notice: This patent is subject to a terminal disclaimer.

[21] Appl. No.: 09/141,595

[22] Filed: Aug. 28, 1998

Related U.S. Application Data

[63] Continuation of application No. 09/017,021, Feb. 2, 1998, Pat. No. 5,863,414.

[51] Int. Cl.[7] ..... B65D 73/00

[52] U.S. Cl. ..... 206/470; 206/777; 206/778

[58] Field of Search ..... 206/461, 466, 206/467, 470, 472, 475, 775, 776, 777, 778, 782

[56] References Cited

U.S. PATENT DOCUMENTS 5,863,414 1/1999 Tilton ..... 206/470

*Primary Examiner*—Jacob K. Ackun

*Attorney, Agent, or Firm*—Laubscher & Laubscher; R. J. Lasker, Esq.

[57] ABSTRACT

A combination paperboard and plastic retaining package, with a paperboard sheet having a window for receiving product and formed by a plastic film overlaying the window and sealed to a portion of the paperboard sheet along the edges of the window; a plastic sheet having a window for retaining product and formed by a plastic film overlaying the window and to a portion of the plastic sheet along the edges of the window; the paperboard sheet and the plastic sheet being joined along a fold-over axis; product being retained by being inserted between each of the windows with the paperboard sheet and plastic sheet being folded over one another along the fold line; the overlapping plastic and paperboard sheets are sealed to one another; printing on selected areas of the plastic sheet; and wherein the selected areas are between the seals along the edges of the window and the seals around the periphery of the paperboard and plastic sheets.

Printing may occur on selected areas of both the plastic sheet and the paperboard sheet.

14 Claims, 2 Drawing Sheets

COMBINED PLASTIC FLEXIBLE FILM AND PAPERBOARD PRODUCT-RETENTION PACKAGES

BACKGROUND OF THE INVENTION

1. Related Applications

This application is a continuation application of application Ser. No. 09/017,021, filed Feb. 2, 1998 and now U.S. Pat. No. 5,863,414.

2. Field of the Invention

This invention relates to product-retaining packages, and more particularly to such product-retaining packages comprising a substantially rigid plastic support (or card) sealed to a corresponding paperboard support (or card) with at least one substantially flexible plastic product compartment and with printing on at least one or both sides side of the combination plastic and paperboard package.

3. Related Art

Presently used packages include paperboard in combination with flexible PVC film (stretch pack) and preformed non-linear unprinted semi-rigid plastic materials sealed to, or in combination with printed paperboard materials (clamshells, blister packs and others). Clamshell-type packages have a 100% plastic exterior (on front and back) such that the rigid plastic structure is on the outside and printed paperboard is contained inside, which results in elevated package component costs as well as inherent potential for printed material damage. No existing packaging option provides for flexible PVC film in combination with both paperboard and printed semi-rigid PVC film.

The plastic or PVC component of blister and clamshell-type packages cannot be satisfactorily printed using lithographic or flexographic methods because of the irregular non-linear surfaces created by the thermoformed plastic exterior. Additionally, a minimum distance between the edge of the product and the edge of the paperboard (or plastic) must be maintained for structural and sealing purposes. Stretch pack and clamshell-type packages require a wide seal band (common for paperboard) on the inside edge of the card border. Also clamshell-type packages have the same limitation when preformed cavities of rigid plastic are close to the edge of the package requiring a flange area. The flange and seal band areas are cosmetically unappealing and limit the surface area for design and printing graphics. This is a major disadvantage because the extra size of the package consumes valuable retail shelf or hanging space which then restricts potential use of the product-retaining package.

Other disadvantages of existing paperboard containing packages (blisters, clamshells, stretch pack) are ease of structural damage. bending and wrinkling of the paperboard components either on the interior or exterior of the package.

Often, in transport and handling, packages containing paperboard are bent and wrinkled. This is a great disadvantage and very cosmetically unappealing. The exterior PVC area on clamshell style packages consisting of semi-rigid PVC (and other plastic materials) is not easily damaged in this manner, however, clamshells are a costly packaging alternative. Clamshell packaging costs are elevated because of excessive amounts of plastic material on the front and back of the package, labor intense assembly required in some applications, costly molds need to thermoform the cavities, and printed paperboard which is required to display graphics (this paperboard is also subject to damage).

The varying sheet thickness of paperboard causes imprecise printing which limits the flexographic or lithographic printing quality. Moreover, 100% paperboard packages have imprecise folding, slitting, and feeding characteristics on automated sealing equipment which is a further disadvantage of using predominantly paperboard in product-retaining packages.

Also, because of preformed rigid cavity construction, clamshell-type packages are not linear and flat, therefore they do not de-nest and feed efficiently. They also cannot be printed. Because the plastic is not printed, a printed paperboard insert is required as an additional material for graphics display.

Several different combinations of printed semi-rigid plastic (PVC and other materials) and flexible PVC film in combination with printed (or unprinted paperboard) possible. Some finished packages have windows on the front and on the reverse side. Some finished packages have windows are on the front and on the reverse side. Some windows are on one side only and some packages have multiple compartments with one or more sides. However, all combinations use essentially the same type materials and process for their manufacture.

SUMMARY OF THE INVENTION

The present invention provides a product-retaining package wherein flat, linear, plastic materials are printed on one side and have a die cut window with non-rigid film such as PVC or surlyn glued to the non-printed surface area resulting in a flat sheet consisting of flexible film and rigid plastic. This flat sheet comprising rigid and plastic film is then printed using flexographic or lithographic methods. Using a separate process with industry standard equipment, the flat printed cards are automatically fed and the flexible film is thermoformed to shape a cavity. Subsequently, product is placed into the cavity. Then a one piece or attached foldover paperboard card is RF, heat sealed, or sonic-sealed together, trapping the product (now in the film cavity) between the printed plastic card and a paperboard card. The package is finished after the sealing process has been completed and multiple "up" cards have been slit into single units. At the point of purchase the consumer tears the package open and discards it after removing the product.

It is a primary object of the present invention to provide a printable package of the type specified herein that contains both printed (or unprinted) paperboard and linear printed plastic material comprising both a semi-rigid sheet and a flexible plastic cavity film for sealing product therein.

It is a feature of the present invention that the finished package is comprised of printed semi-rigid plastic in combination with a flexible film which is then sealed to printed paperboard materials.

It is an advantage of the present invention to provide a printed plastic, flexible film, and paperboard package that demonstrates structural performance characteristics currently found in existing clamshell style packages at a much lower cost with high graphic quality than a clamshell containing a paperboard insert card. Decreased costs result from the use of printed plastics, thermoformed flexible film, and paperboard in combination. Also cost reduction is achieved thorough more efficient packaging methods.

It is a further object of the invention to provide a sealed, printed plastic, flexible film, and paperboard package having smaller seals between the components to retain the product (s), thereby reducing the size of the package.

It is a further feature of the present invention that the sealed printed plastic package, flexible film, and paperboard package provide a small RF band seal which eliminates the need for a wide band seal inside the perimeter of the package.

It is a further feature that the sealed package of the invention provides a small RF band seal which eliminates the need for a wide band seal inside the perimeter of the package.

It is a further advantage of the sealed product-retaining package of the invention that the package size may be reduced because of the reduction in the sealing band.

It is yet a further object of the sealed product-retaining package of the invention that wrinkling, creasing, breaking and separating of the components associated with other paperboard containing packages is greatly reduced due to the sealing of the flat plastic portion of the package against the surface of the paperboard portion, thereby adding strength and flexibility to the package.

It is yet a further feature and advantage of the invention that the performance, appearance and durability thereof are greatly increased over known composite paperboard-plastic type product-retaining packages.

It is still a further object of the invention to provide a sealed, plastic, flexible film, and paperboard product-retaining package enabling printing on the plastic components of the package.

It is another feature of the invention that there is tighter thickness tolerance of plastic as compared to paperboard materials.

It is another advantage of the invention that improved print registration is obtainable due to the tighter thickness tolerances of plastic versus paperboard materials.

It is yet another object of the invention to provide a sealed, plastic, flexible film and paperboard product-retaining package enabling enhanced production techniques.

BRIEF DESCRIPTION OF THE DRAWINGS

The above objects, features and advantages are believed to be readily apparent from the following description of a preferred embodiment of the invention representing the best mode of carrying out the invention, wherein.

DETAILED DESCRIPTION

Figure 1:
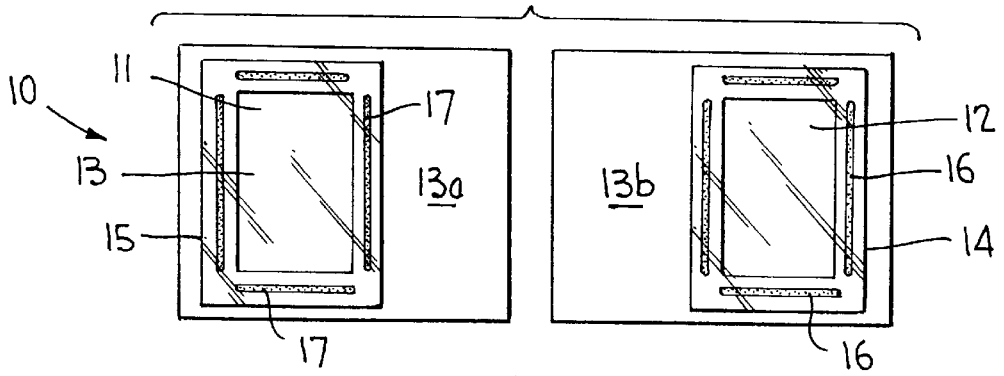
FIG. 1 is a view of the reverse side a two-piece plastic, flexible film front and paperboard back product-retaining package "2P3F " in accordance with the invention.

The reverse side of a two piece, plastic, flexible film front and paperboard back "2P3F " product-retaining package 10 in accordance the invention shown in FIG. 1 includes die cut windows 11 and 12, respectively, cut in plastic sheet 13*a* and paperboard sheet 13*b*. Plastic film overlays 14 and 15 cover the die cut windows 12 and 13, respectively. The flexible plastic film overlays 14 and 15 are retained by glue lines 16 and 17, respectively. Throughout the following description it is understood that the techniques for producing the product-retention package of the invention are made by well known techniques which are applied to plastic, flexible film, and paperboard materials in a manner well known to those skilled in the art of product-retention packages such as stretch pack and clamshell-type product-retention packages using composition materials, i.e. plastic and paperboard.

Figure 2:
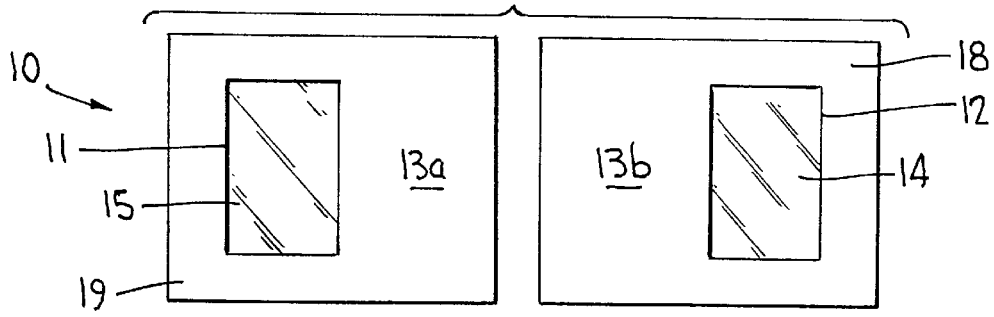
FIG. 2 is a front view of the two-piece, plastic, flexible film front and paperboard back product-retaining package of FIG. 1.

FIG. 2 illustrates the front side of the two-piece, plastic, flexible film front and paperboard back product-retaining package 10 of FIG. 1 with die cut windows 11 and 12 and respective plastic film overlays 14 and 15. Printed graphic areas 18 and 19 appear respectively on plastic card 13*a* and paperboard card 13*b*. This printing is carried out by well known printing techniques such as flexographic and lithographic printing, but in accordance with the invention, the printing is applied to the plastic sheet as opposed to paperboard (contained in or outside of the package) as in prior art configurations. When cards or sheets 13*a* and 13*b* are folded and sealed together to trap the product between the plastic overlays 14 and 15, printed graphics are possible on both the front and back of the package.

Figure 3:
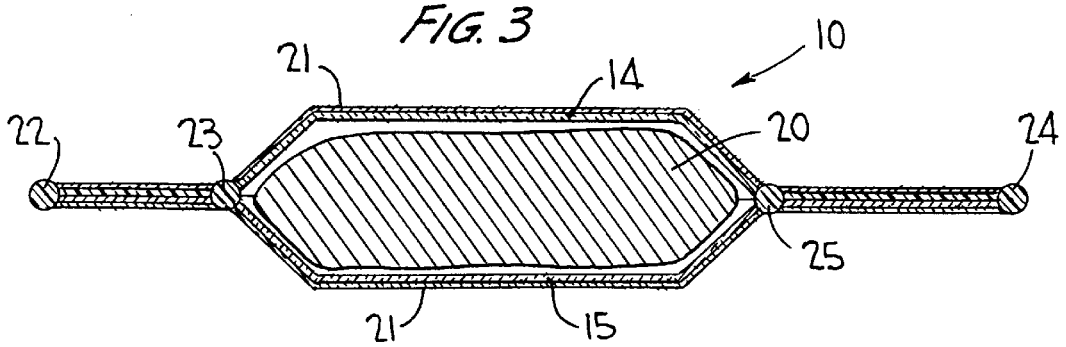
FIG. 3 is a sectional view of a two piece, plastic, flexible film front and paperboard back product-retaining package-containing product in accordance with the invention.

In the sectional view of a printed plastic, flexible film, and paperboard package in accordance with the invention as illustrated in FIG. 3, which represents the result of folding the plastic card of FIGS. 1 and 2 so that the product 20 is entrapped between window overlays 14 and 15, a PVC film 21 covers the plastic product-retention package 10 and the window overlays 14 and 15 with the entrapped product. The entire assembly is RF, heat or sonic sealed to form narrow 1/16 inch weld bands 22, 23, 24 and 25 as illustrated in FIG. 3. Weld bands 23 and 24 are formed on the outer portion of the printed plastic, flexible film, and paperboard package 10. Weld bands 23 and 25 are formed on the edges of the respective windows as shown in FIG. 3. The narrow weld bands 23 and 25 enable graphics to be printed in the areas between bands 22–23 and 24–25 respectively.

Figure 4:
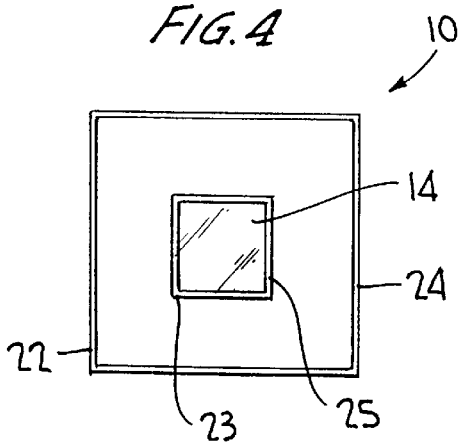
FIG. 4 is a front view of a complete two piece, plastic, flexible film front and paperboard back product-retaining package showing a minimum RF seal band width.
Figure 5:
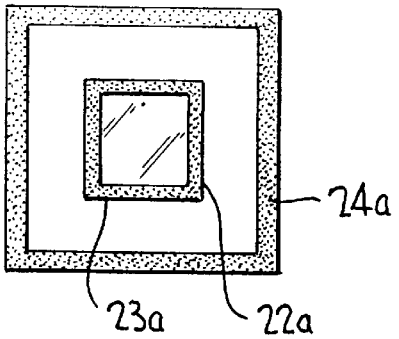
FIG. 5 (PRIOR ART)
FIG. 5 is a front view of a complete two piece, plastic, flexible film front and paperboard back product-retaining package showing a minimum RF seal and/or flange area.

FIG. 4 illustrates the 1/16 inch RF weld bands 22, 23, 24 and 25 as they appear around the window 14 of product retention package 10. The narrow RF weld bands enable a significant increase in the graphics area that is available in accordance with the present invention over that obtainable with prior art packaging techniques as is apparent from a consideration of FIG. 5 which represents a stretch pack, blister pack or clamshell-type card with a flange. In such prior art products there are 3/8 inch wide band RF seals 22*a*, 223*a*and 24*a*.

Figure 6:
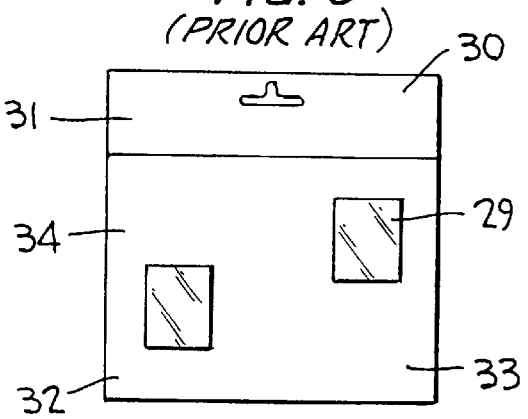
FIG. 6 (PRIOR ART)
FIG. 6 is a front view of clamshell-type package with a printed paperboard insert card.

FIG. 6 is a front view of a clamshell-type package with an insert card 34 and illustrating a package header 31 which includes a transparent zone 31. Non-transparent areas 32 and 33 of insert paperboard 34 block viewing through the clear plastic. Paperboard 34 is susceptible to damage if the package is subject to bending or impact.

Figure 7:
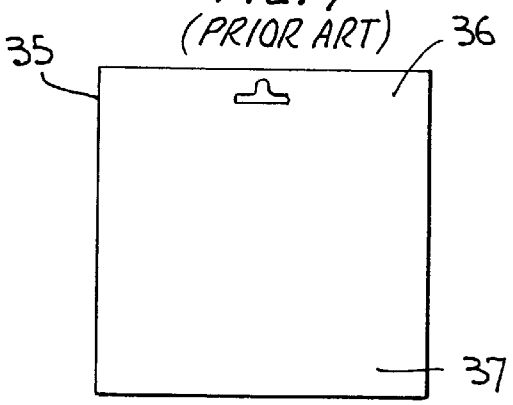
FIG. 7 (PRIOR ART)
FIG. 7 is a front view of a stretch pack card.
Figure 8:
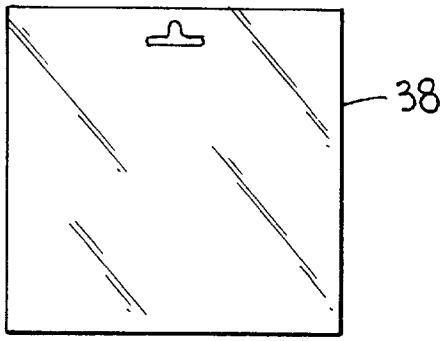
FIG. 8 is a front view of a plastic sheet used in the two piece, plastic, flexible film front and paperboard back product-retaining package.

FIG. 7 illustrates a stretch pack card 35 including non-transparent areas which are subject to damage such as tearing and bending during normal handling and shipment. FIG. 8 is a front view of an all plastic card 38 in accordance with the invention and in which the entire area of the card is fully pliable, less susceptible to damage, and fully transparent in the non-printed areas.

Figure 9A:
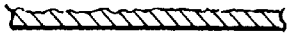
FIG. 9a (PRIOR ART)
FIGS. 9A and 9B, respectively show side views of a paperboard insert for either a stretch and clamshell-type package.
Figure 9B:
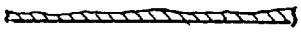
FIG. 9b (PRIOR ART)
Figure 10:
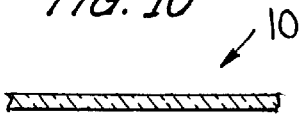
FIG. 10 is a side view of a plastic sheet used in the plastic product-retention package of the invention.

FIGS. 9*a* and 9*b* are respective side views of paperboard illustrating the non-uniformity in paperboard stock used in stretch card and clamshell-type packages and the inconsistent thickness of which inhibits high quality and flexographic or lithographic printing. FIG. 10 is a side view of a typical plastic card or film used in the present invention and which has a more consistent thickness, thereby enabling high quality flexographic or lithographic printing.

Table I is a list of common RF sealable plastics which can be used in the previously described all plastic package of the invention.

The above description serves only to describe exemplary embodiments of the best mode of making the invention to demonstrate the features and advantages of its construction and operation. The invention is not intended to be limited thereby, as those skilled in the art of product-retention packages will readily perceive modifications of the above-described embodiments. Thus the invention is intended to be limited only by the following claims and the equivalents to which the claimed components thereof are entitled.

What I claim is:

1. A combination paperboard and plastic retaining package, comprising:

a paperboard sheet having a window for receiving product and formed by a plastic film overlaying said window and sealed to a portion of said paperboard sheet along the edges of said window;

a plastic sheet having a window for retaining product and formed by a plastic film overlaying said window and to a portion of said plastic sheet along the edges of said window;

said paperboard sheet and said plastic sheet being joined along a fold-over axis;

product being retained by being inserted between each of the windows with said paperboard sheet and plastic sheet being folded over one another along said fold line;

the overlapping plastic and paperboard sheets are sealed to one another;

printing on selected areas of said paperboard sheet; and wherein the selected areas are between the seals along the edges of said window and the seals around the periphery of said paperboard and plastic sheets.

2. A combination paperboard and plastic retaining package, comprising:

a paperboard sheet having a window for receiving product and formed by a plastic film overlaying said window and sealed to a portion of said paperboard sheet along the edges of said window;

a plastic sheet having a window for retaining product and formed by a plastic film overlaying said window and to a portion of said plastic sheet along the edges of said window;

said paperboard sheet and said plastic sheet being joined along a fold-over axis;

product being retained by being inserted between each of the windows with said paperboard sheet and plastic sheet being folded over one another along said fold line;

the overlapping plastic and paperboard sheets are sealed to one another;

printing on selected areas of said plastic sheet; and wherein the selected areas are between the seals along the edges of said window and the seals around the periphery of said paperboard and plastic sheets.

3. A combination paperboard and plastic retaining package, comprising:

a paperboard sheet having a window for receiving product and formed by a plastic film overlaying said window and sealed to a portion of said paperboard sheet along the edges of said window;

a plastic sheet having a window for retaining product and formed by a plastic film overlaying said window and to a portion of said plastic sheet along the edges of said window;

said paperboard sheet and said plastic sheet being joined along a fold-over axis;

product being retained by being inserted between each of the windows with said paperboard sheet and plastic sheet being folded over one another along said fold line;

the overlapping plastic and paperboard sheets are sealed to one another;

printing on selected areas of said paperboard sheet;

printing on selected areas of both said plastic sheet and said paperboard sheet; and wherein the selected areas are between the seals along the edges of said window and the seals around the periphery of said paperboard and plastic sheets.

4. A combination paperboard and plastic retaining package, comprising:

a paperboard sheet having a window for receiving product and formed by a plastic film overlaying said window and sealed to a portion of said paperboard sheet along the edges of said window;

a plastic sheet having a window for retaining product and formed by a plastic film overlaying said window and sealed to a portion of said plastic sheet along the edges of said window;

said paperboard sheet and said plastic sheet being separate sheets;

product being retained by being inserted between each of the windows and the respective windows of said paperboard sheet and plastic sheet being aligned over one another; and the overlapping plastic and paperboard sheets are sealed to one another.

5. A combination paperboard and plastic retaining package according to claim 4, wherein the seal is formed around the peripheral edges of said paperboard and plastic sheets.

6. The combination according to claim 5, wherein the window seals and the seal around the peripheral edges of said paperboard and plastic sheets are RF seals having a width of approximately 1/16 inch.

7. The combination according to claim 5, wherein the window seals and the seal around the peripheral edges of said paperboard and plastic sheets are heat seals having a width of approximately 1/16 inch.

8. The combination according to claim 5, wherein the window seals and the seal around the peripheral edges of said paperboard and plastic sheets are sonic seals having a width of approximately 1/16 inch.

9.The combination according to claim 4, further comprising printing on selected areas of said paperboard sheet.

10. The combination according to claim 4, further comprising printing on selected areas of said plastic sheet.

11. The combination according to claim 4, further comprising printing on selected areas of both said plastic and paperboard sheets.

12. The combination according to claim 9, wherein the selected areas are between the seals along the edges of said window and the seals around the periphery of said paperboard and plastic sheets.

13. The combination according to claim 10, wherein the selected areas are between the seals along the edges of said window and the seals around the periphery of said paperboard and plastic sheets.

14. The combination according to claim 11, wherein the selected areas are between the seals along the edges of said window and the seals around the periphery of said paperboard and plastic sheets.

* * * * *